US005107579A

United States Patent [19]

Köstermeier

[11] Patent Number: 5,107,579

[45] Date of Patent: Apr. 28, 1992

[54] PROCESS OF FORMING A FOLDED SEAM CONNECTION BETWEEN TWO CUP-SHAPED WORKPIECES

[75] Inventor: Karl-Heinz Köstermeier, Rietberg, Fed. Rep. of Germany

[73] Assignee: Leifeld GmbH & Co., Ahlen, Fed. Rep. of Germany

[21] Appl. No.: 603,461

[22] Filed: Oct. 25, 1990

[51] Int. Cl.[5] ..... B21D 39/02

[52] U.S. Cl. ..... 29/463; 29/513; 29/521

[58] Field of Search ..... 29/429, 463, 509, 511, 29/513, 521, 243.5, 283.5

[56] References Cited

U.S. PATENT DOCUMENTS

| | | | |
|---|---|---|---|
| 4,441,241 | 4/1984 | Hoeffken | 29/463 |
| 4,513,487 | 4/1985 | Binnie | 29/243.5 |
| 4,554,718 | 11/1985 | Ollinger et al. | 29/429 |
| 4,756,069 | 7/1988 | Morikawa | 29/463 |
| 4,989,308 | 2/1991 | Sanders | 29/243.5 |

*Primary Examiner*—P. W. Echols
*Assistant Examiner*—David P. Bryant
*Attorney, Agent, or Firm*—Felfe & Lynch

[57] ABSTRACT

Process and apparatus for producing a folded seam connection along a joint between cups made of sheet metal having flanges of folded seam connection and forming a workpiece, in particular a vibration damper, wherein at least one folding tool and the workpiece with the folding flanges, which are pressed on each other, are moved relative to one another. The workpiece is rotated around a rotating axis traversing the workpiece in an essentially perpendicular manner with respect to the plane of the joint. The folded seam connection is produced by rolling over the folding flanges once or several times by at least one folding roller. In the plane of the joint, the folding roller can be swung around relative to the workpiece and/or pressed against the latter. The process and the seaming machine offer the option to simply pass over interruptions of the folded seam connections by providing a correspondingly configured guide surface for the folding roller.

5 Claims, 4 Drawing Sheets

PROCESS OF FORMING A FOLDED SEAM CONNECTION BETWEEN TWO CUP-SHAPED WORKPIECES

BACKGROUND OF THE INVENTION

The invention relates to a process for producing a folded seam along a joint between partial cups made of sheet metal and having flanges which are so connected to form a workpiece, in particular a cup-shaped vibration damper. The invention further relates to a seaming machine for practicing the method, wherein the partial cups are placed in respective workpiece holders with their flanges pressed together and moved continuously relative to at least one folding tool.

DE-U 85 17 513 discloses that the workpiece holders holding the partial cups can be rotated around an axis running in the plane of joint. To the side of the workpiece movable seam folding robots. The workpiece elements thereof are independently powered in one direction of moving corresponding to the characteristic of the folded seam. The seaming machine has prongs and the folded seam is created in intermittent steps in that the seam folding tool is alternatingly opened, closed and laterally moved. Since the workpiece holders can be rotated, it is possible to successively produce two opposing folded seams by means of one seam folding tool. A disadvantage of this known seaming machine is the time-consuming method of operation and the consequent low productivity. Moreover, this machine permits the manufacture of only straight folded seams. In order to produce folded seams of a more complicated structure, the machine would require an additional direction of moving which in turn would involve a substantially more complex structure and control.

Moreover, it is known to produce folded seam connections of the aforesaid kind in presses where the partial cups are in fixed positions in the workpiece holders and where the seam is produced by the hammer-like use of external pressing tools. Here, the seam must be in the plane of the longest extension of the workpiece in order to advance the pressing tools. The so produced folded seam connections do not meet high quality standards since only one pressing process is possible and since a firm and tight folded seam is not possible due to the resilience of the sheet metal used for the partial cups. This problem occurs in particular during forming processes with highly resilient noble steel sheet. Moreover, there is a great amount of labor and cost involved in the manufacture of the tools which in addition are subject to high degree of wear.

SUMMARY OF THE INVENTION

It is hence an object to provide a process for producing a folded seam connection and a seaming machine where operating speed and quality are increased and which can be employed for a variety of options.

This object is accomplished in accordance with the invention by a process and a seaming machine of the aforesaid kind having the characterizing features of claim 1 and/or claim 4.

The new process and the new seaming machine have the advantage of a continuous operation since the folded seam is produced in a rolling procedure. Further, several seam folding procedures can be easily carried out thus allowing a superior working quality, especially when machining noble steel, for example. Another essential advantage is that the shape of the workpiece and, hence, the characteristic course of the folded seam may greatly vary, since it is possible, for example, to machine non-round, not rotationally symmetrical workpieces since the seam folding roller is capable of following a movement corresponding to the contour of the seam to be folded. It is even possible that the workpiece have concave radii provided these radii remain larger than the radius of the seam folding roller. Also, the folded seam must not necessarily lie in the plane of the longest extension of the workpiece since the seam folding rollers are advanced toward the workpiece laterally from the outside on an arm requiring only little moving space. When machining workpieces where the folded seam is located on one plane, it suffices to configure the seam folding roller and the arm of the seaming machine such that they can be swung around only in the plane of the joint. When the arm and the roller or the workpiece holders are provided with another direction of moving, it is even possible to produce folded seam connections which are not located on only one plane. The new process and the new seam folding machine can hence be used for a plurality of options and even allow the manufacture of folded seam connection of a more complicated structure where the folding roller is guided either by the seam itself which is to be folded or by special guide means.

With respect to guiding the seam folding roller, the invention proposes to guide the latter on a guide roller running on a guide surface which rotates along with workpiece and that the guiding be in a direction that is relative to the workpiece and essentially radial thereto. In accordance with the apparatus, an improvement of the invention proposes that a guide roller be provided at the free end of the folding arm toward the folding roller such that it is offset in the axial direction thereof. This guide roller can also be rotated around an axis that runs parallel to the rotating axis of the workpiece, and during the folding of the seam, it runs on a guide surface and/or curve which is configured as a part of the workpiece holders. This is a simple way of making provision for a guiding for the seam folding roller rendering the folding procedure independent of the properties as well as the measurement and form deviations of the folding flanges of the workpieces.

In another embodiment of the invention, a corresponding configuration of the process and the seaming machine, e.g. an elevation of the guide surface, permits continuing the folding of the seam by simply passing over areas of the workpiece where the seam is interrupted and then continue folding the seam without requiring additional control measures. In the same manner, it is possible to provide an elevation of the guide surface for parts of the workpiece, e.g. connecting pieces for pipes, which protrude from it toward the exterior in the folding area.

DETAILED DESCRIPTION OF THE PREFERRED EMBODIMENT

Figure 1:
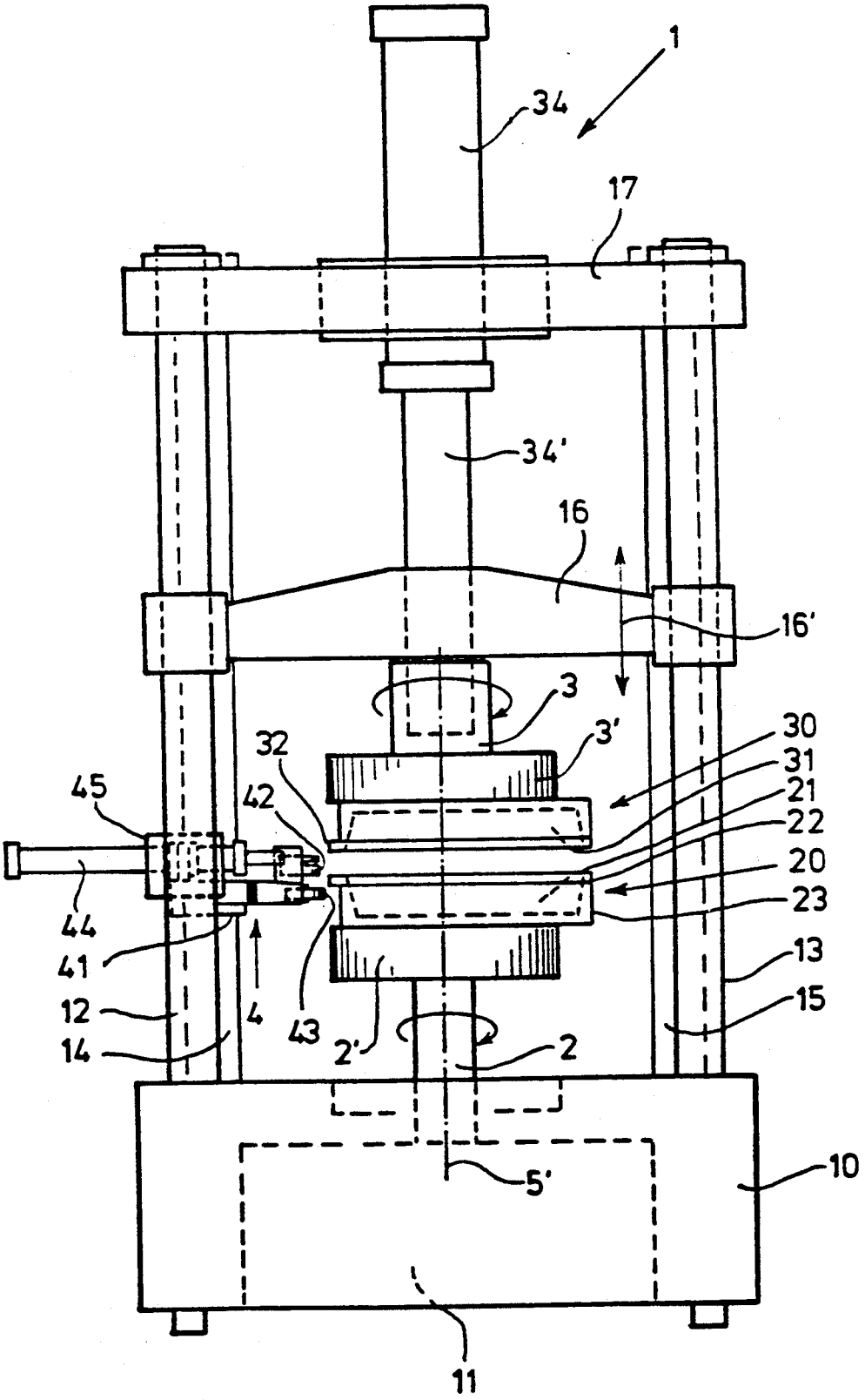
FIG. 1 is a side view of a first embodiment of a seaming machine with a folding arm.

As seen in FIG. 1, the embodiment of the seaming machine 1 represented here has a pedestal 10 accommodating a drive and gear unit 11. A total of four parallel guide columns 12, 13, 14, and 15 extend upwardly from this pedestal 10. At their top ends, these guide columns 12 to 15 are joined via a yoke 17. Underneath the yoke, there is a pressure plate 16 which can be raised and lowered along the guide columns 12 to 15 as indicated by arrow 16'. The lowering and raising of the pressure plate 16 is executed by a lifting cylinder 34 which is centrally attached to the yoke 17. The corresponding piston rod 34' extends downwardly from the cylinder 34 to the pressure plate 16 where it is connected to the latter.

A main spindle 2 extends upwardly from the above mentioned drive and gear unit 11 by which it is also set in a rotating motion. At its top end, the main spindle 2 supports a first tool holding flange 2' which in this case has the form of a flat cylinder and is disposed concentrically with respect to the main spindle 2. Below the pressure plate 16, there is a pressure head 3 which can be raised and lowered together with the pressure plate 16 but also can be rotated with respect thereto. At its bottom end, the pressure head 3 has a second tool holding flange 3' also in the form of flat cylinder similar to the first lower tool holding flange 2'. The pressure head 3 and the corresponding tool holding flange 3' are also disposed concentrically with respect to one another and in alignment with the main spindle 2.

Each of the lower tool holding flange 2' and the upper tool holding flange 3' has a workpiece holder 20 and 30, respectively, which are configured as tools matching a workpiece to be machined and attached to the tool holding flanges 2' and 3' in a preferred threaded connection. The two workpiece holders 20 and 30 are provided with cup-like indentations 21 and 31 each of which form-fittingly holds a semi-cup of a workpiece to be machined, e.g. a cup-shaped vibration damper consisting of two semicups or partial cups. In order to achieve a most simple and exact matching of the surface contours of the indentations 21 and 31, the workpiece holders 20 and 30 have an inside plastic coating which is made of a pourable plastic exhibiting little elasticity after hardening. This permits an absolutely form-fitting manufacture of the internal contour of the cup-like indentations 21 and 31 in the workpiece holders 20 and 30 by pouring in the plastic in a liquid form, pressing in a sample of the workpiece and/or the corresponding partial cup and then allowing the plastic material to harden.

The partitioning plane of the two workpiece holders 20 and 30 coincides with the plane of the joint of the two partial cups of the workpiece to be machined.

At the their front surfaces facing each other, each of the two workpiece holders 20 and 30 has a circumferential seam folding surface 22 and 32 which serves as a contact pressure surface during the folding procedure.

Further, in the represented embodiment of the seaming machine 1, the lower workpiece holder 20 has a circumferential guide surface 23 underneath its folding surface 22. The latter, as will be explained hereinafter, may exhibit different radial distances from the folding surface 22.

Further, FIG. 1 shows a folding arm 4 which, in this example, is disposed to the left of the workpiece holders 20 and 30. This folding arm 4 is configured as an arm that can be swung around while supported in a swivel bearing 41 which in FIG. 1 is disposed at the rear left side of the guide column !4. At its free end, in FIG. 1 on the right side, the folding arm 4 holds a guide roller 43 which runs on the guide surface 23 of the workpiece holder 20 during the seam folding procedure.

Above the guide roller 43, there is a folding roller 42 which is also slightly set back with respect to the guide roller 43, i.e. in FIG. 1 toward the left side. During seam folding procedure, this folding roller 42 runs on at least one of the two circumferential folding surfaces 22 and 32 of the workpiece holders 20 and 30 with the flanges of the workpiece to be folded being therebetween. The contact pressure of the folding roller 42 in direction to the workpiece holders 20 and 30, which is required for the folding procedure, is generated by a contact pressure cylinder 44 which in turn is supported in bearing block 45 by the left front guide column 12 of FIG. 1 where it can be swung around. In this seaming machine the contact pressure cylinder is preferably powered such that it applies a constant force regardless of the position of its piston and its piston rod.

In the embodiment of FIG. 1, the seaming machine represented has only one single folding arm 4. However, for the practical application of the folding machine 1, it is expedient that the machine 1 be provided with a pair of identical folding arms 4 or even several pairs of identical folding arms 4.

Figure 2:
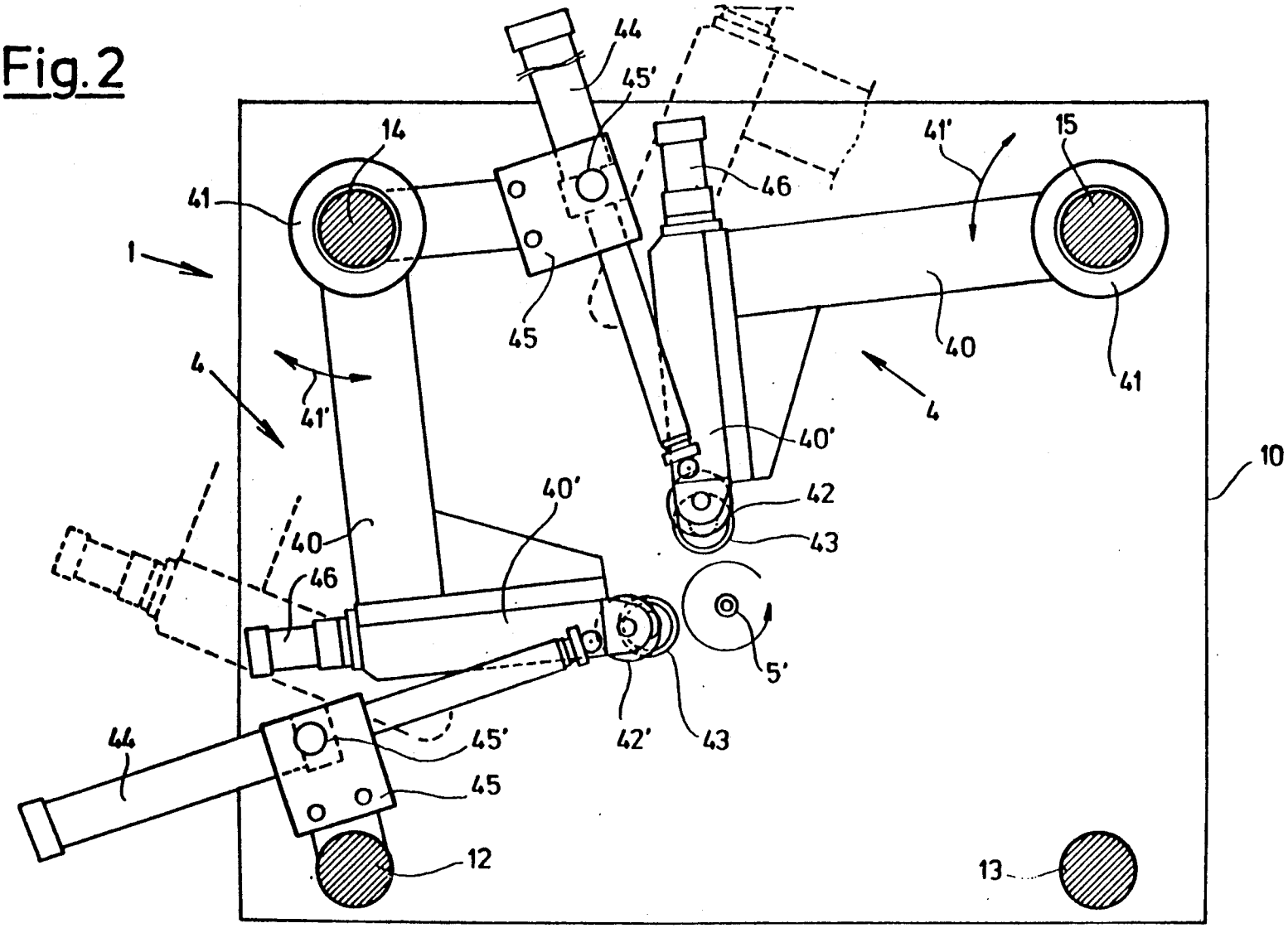
FIG. 2 is a top view in a partially horizontal section of a second embodiment of a seaming machine with two folding arms.

FIG. 2 shows an embodiment of the seaming machine 1 where the latter is equipped with a pair of identical folding arms 4. For the drawing to be clearly arranged, the representation includes only the two folding arms 4 and the pedestal 10 in a top view and the four guide columns 12 to 15 in cross sectional view. Those parts of the seaming machine 1 that are present underneath the folding arms 4, in particular the workpiece holder 20, are not represented in this example.

As seen in FIG. 2, each of the two folding arms 4 has an essentially rectangular L-shape with a long L-side 40 and a shorter L-side 40'. At its outer end, the long L-side 40 is configured as a swivel bearing 41 and on the corresponding guide column 14 and 15, it is supported such that it can be swung around. This is indicated by arrows 41'. At their free, inner ends, each of the shorter L-side 40' has a folding roller 42 and 42' and a guide roller 43. The two guide rollers 43 are identical in this example whereas the folding rollers 42 and 42' preferably have distinct profiles. The rollers 42, 42' and 43 can be rotated around axes parallel to the rotating axis 5' of the workpiece.

The aforesaid contact pressure cylinders 44 which run at an acute angle with regard to the respectively shorter L-side 40' serve to provide the contact pressure necessary for the folding of the seam. Each of these cylinders is supported in a swivel bearing 45', each at one bearing block 45, which in turn is rigidly connected to a stationary part of the seaming machine 1, for example, the guide column 14 and/or 12. The piston rod of the cylinder 44 extends from the bearing block 45 toward the inside close toward the inner end of the shorter L-side 40'.

In addition, the represented embodiment of the seaming machine 1 is provided with an adjusting cylinder 46 at each of its folding arms 4. The purpose thereof is to adjust the folding roller 42 and 42' in its position relative to the guide roller 43. This allows to gradually adjust the position of the folding rollers 42 and 42' to various passage of the folding procedure for a stepwise execution of the seam folding. Also, when the profiles of the folding rollers 42 and 42' are different, the option is given to first start the folding with the first folding roller 42 and to make use of the second folding roller 42' after a corresponding rotation of the workpiece around the rotating axis 5'.

As further seen in FIG. 2, the two seam folding arms 4 are arranged around the rotating axis of the workpiece such that they are offset with respect to one another by approximately 90°. In workpieces where the folding of the seam forms a geometric contour line with very different semiaxes, this arrangement has the advantage that the torques generated at the workpiece by the folding arms 4 eliminate one another at least partially. Further, it can be understood from FIG. 2 that the folding arms 4 extend from the swivel bearings 41 in rotating direction of the workpiece and then inwardly bend down toward the rotating axis 5' of the workpiece. On the one side, the amount of space required for approaching the folding arms 4 to the workpiece is thus only very small. On the other side, due to the configuration of the folding arms 4 in the manner of a drag lever, the forces that occur when forming workpieces, which have non-round or even concave folding lines, are maintained at a relatively low level.

Figure 3B:
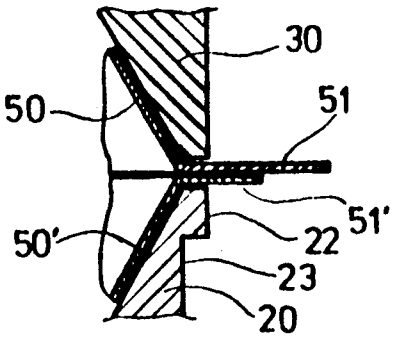
FIG. 3*b* is a partial cross section of the workpiece of FIG. 3*a* taken along line III—III in FIG. 3*a*, FIGS. 4*a* and 4*b* represent, corresponding to the representation of FIG. 3*b*, a first method of operation of the seaming machine in two operational steps.
Figure 3A:
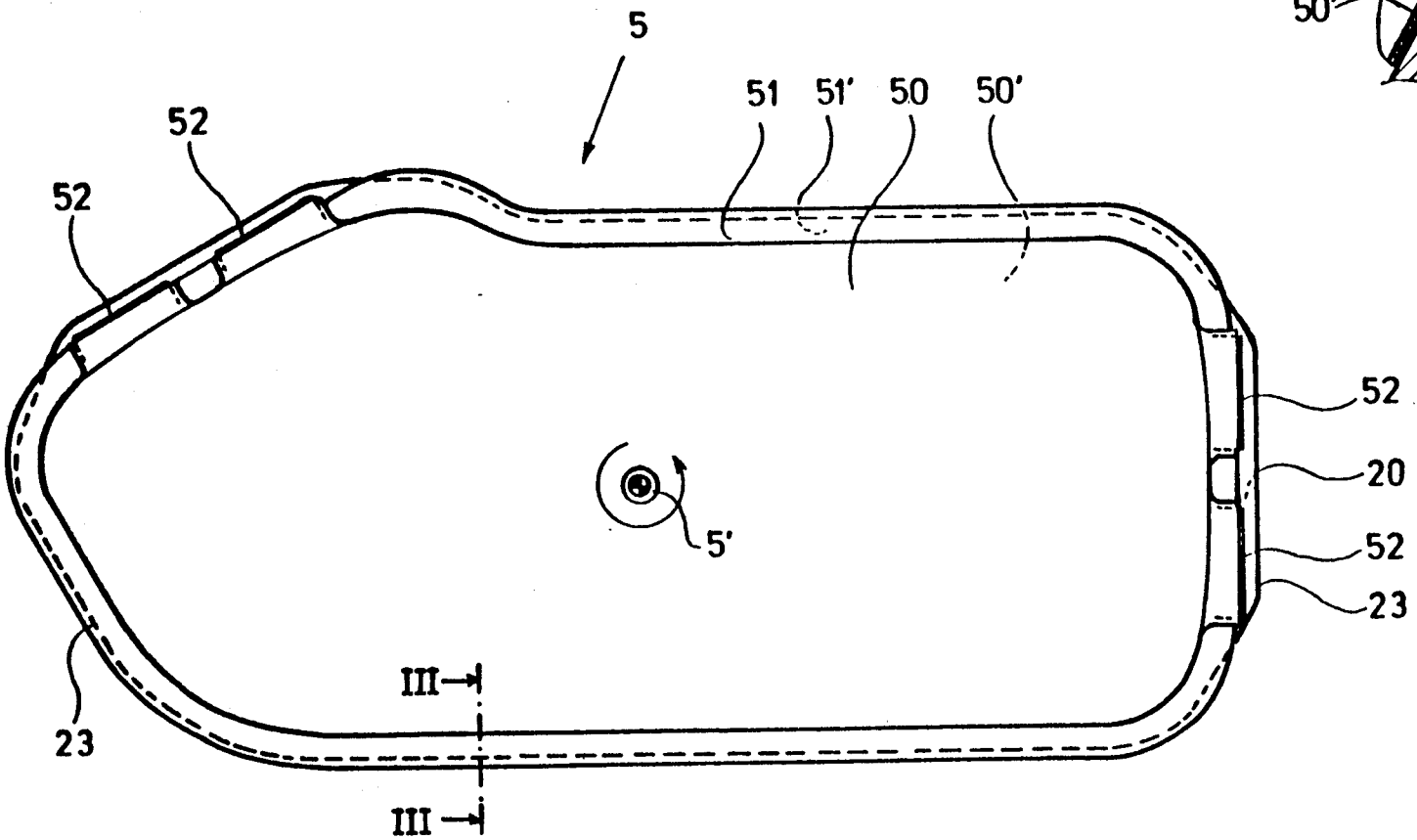
FIG. 3*a* is a top view of a workpiece to be machined in a seaming machine.

FIG. 3*a* is a top view of an example for a workpiece 5 which can be formed using the above described seaming machine 1. Attention is drawn to the upper cup 50 of the workpiece 5 having a folding flange 51 which protrudes toward the outside. In each of two partial areas, this folding flange 51 is interrupted by a pair of pipe connections 52. Underneath the upper cup 50 is the lower cup 50' of the workpiece 5 (FIG. 3*b*). This lower cup 50' in turn also has a protruding folding flange 51' which runs parallel to the top folding flange 51 but has a smaller width. Further, the lower workpiece holder 20, or the circumferential guide surface 23 thereof to be more exact, which form-fittingly holds the lower cup 50' of the workpiece 5', can be seen in partial areas of FIG. 3*a*. As clearly seen in FIG. 3*a*, the guide surface 23 in the area of the folding flanges 51 and 51' runs parallel thereto and shifted toward the inside. In the area of the pipe connections 52, however, the guide surface 23 is elevated, i.e. extends beyond the outer boundary of the pipe connections 52 toward the outside. This serves to lift the folding rollers 42, 42' on the folding arm from the workpiece by means of the guide roller 43, which moves on the described guide surface 23, in the area of the pipe connections 52 to such an extent that these folding rollers pass said pipe connections 52 without contacting them. In the remaining area of the workpiece 5, however, the seam is folded while the workpiece 5 is constantly rotated around its rotating axis 5'.

The partial cross section of FIG. 3*b* taken along line III—III in FIG. 3*a*, illustrates how the two partial cups of the workpiece 5, i.e. the upper cup 50 and the lower cup 50', are associated with one another. The upper cup 50 and the lower cup 50' rest on each other with parallel folding flanges 51 and 51' and are firmly pressed on each other by means of the front surfaces of the partly visible workpiece holders 20 and 30. Here, the upper folding flange 51 of the upper cup 50 has a larger width, i.e. a greater extension toward the outside, than the lower folding flange 51' of the lower cup 50'.

Underneath the two folding flanges 51 and 51', it is possible to recognize the circumferential folding surface 22 of the lower workpiece holder 20 and the circumferential guide surface 23 which in turn is therebelow.

The following explains the process and the method of operation of the seaming machine I with reference to two exemplary operating sequences in accordance with FIGS. 4*a* and 4*b* and 5*a* to 5*c*.

Regardless of what operating sequence follows, the first step is always to insert the upper cup 50 and the lower cup 50' of the workpiece 5 in the respective workpiece holders 20 and 30. The upper workpiece holder 30 is raised by means of a lifting cylinder 34. After insertion of upper cup 50 and lower cup 50', the upper workpiece holder 20 is lowered by means of the lifting cylinder 34 and by applying sufficient contact pressure, it is pressed against the lower workpiece holder 20. The protruding folding flanges 51 and 51' of the workpiece 5 are hereby firmly pressed on each other so that a mutual displacement is practically no longer possible. Subsequently, the drive and gear unit 11 sets the main spindle 2 into rotation which in turn also sets the two workpiece holders 20 and 30, together with the workpiece 5 contained therein, in rotation. Subsequently, at least one of the folding arms 4 is swung around to approach the workpiece 5 until the folding roller 42 and/or 42' contacts the folding flanges 51 and 51' under sufficient contact pressure.

Figure 4B:
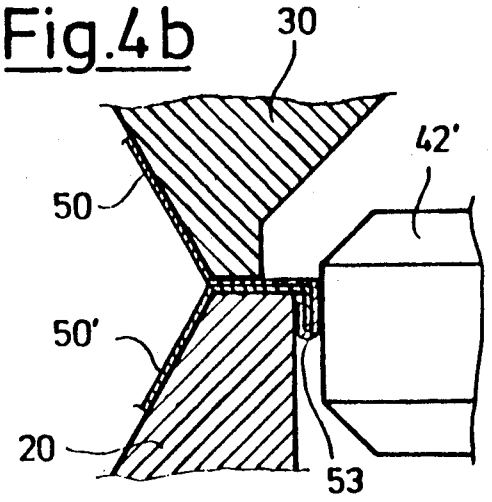
Figure 4A:
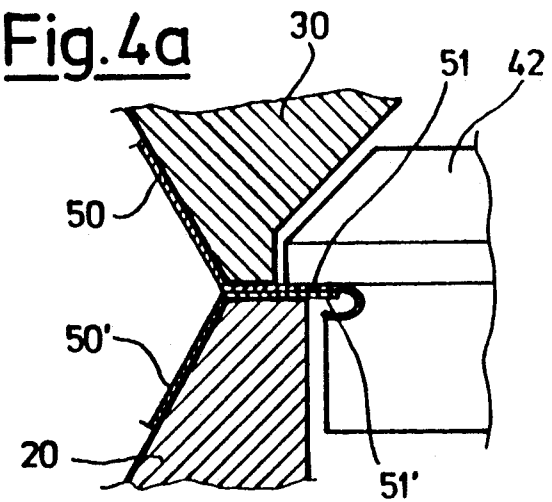

In continuing the operation, a first operating example according to FIG. 4*a* proposes to carry out a pre-folding of the seam wherein the first folding roller 42 folds the upper flange 51 toward the bottom and the inside. This pre-folding can be carried out in one or several passages, i.e. rotations of the workpiece 5. The folding flange 51' of the lower cup 50 still retains its shape at this point.

According to the first operating example shown in FIG. 4*b*, the second folding roller 42' is brought in contact with the folding flanges 51 and 51' thus producing the final folding of the folding flanges 51 and 51' to form the finished folded seam 53 with the individual layers of the folded seam 53 firmly resting on one another. Those areas of the workpiece 5, where the folded seam is to be interrupted or which has protruding parts, are passed without deformation by lifting the folding roller 42 and 42'.

As shown in FIGS. 4*a* and 4*b*, this example of operating sequences requires two folding rollers 42 and 42' of a very different profile wherein the first folding roller 42 executes only the pre-folding and the second roller 42' only completes the folding.

Figure 5C:
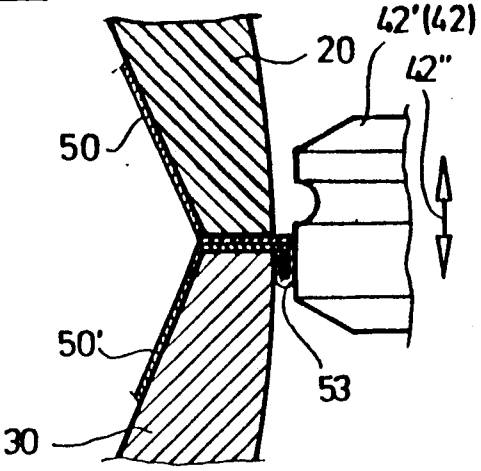
FIGS. 5*a* to 5*c* represent, each also corresponding to the representation of FIG. 3*a*, a second method of operation of the seaming machine in three operational steps.
Figure 5B:
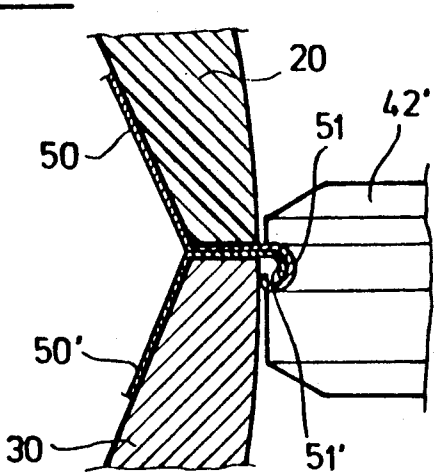
Figure 5A:
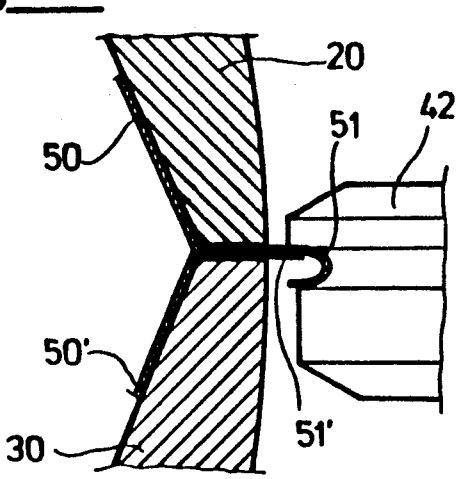

In the second procedural example according to FIGS. 5*a* to 5*c*, it is possible to use each of the folding rollers 42 and 42' for two different folding procedures. According to FIG. 5*a*, the first folding roller 42 pre-folds the upper folding flange 51 toward the bottom and the inside whereas the lower folding flange 51' still retains its shape. During a second passage through the machine, FIG. 5*b* shows how the upper flange 51 is further folded toward the inside with the lower folding flange 51' also being folded toward the bottom. In the last passage according to FIG. 5*c*, the folding procedure to produce the finished folded seam 53 is completed.

Here, it is possible to use either folding roller 42 or folding roller 42' or even both folding rollers 42 and 42' in synchronicity.

What is claimed is:

1. Process of producing a folded seam connection between two cup-shaped workpieces of sheet metal, each workpiece having a folding flange lying in a plane, said process comprising:

placing said flanges together to form an assembly having a joint lying in a plane, rotating said assembly about an axis of rotation which is essentially perpendicular to the plane of the joint, forming a folded seam connection between said workpieces by folding said flanges with at least one folding roller which is guided radially with respect to said axis by guide means moving on a guide surface which rotates with said assembly about said axis of rotation of said assembly.

2. Process in accordance with claim 1 wherein the relative movement of the guide means across the guide surface is also carried out in areas where the folding roller does not engage the folding flanges.

3. Process as in claim 1 wherein said folding roller has an axis of rotation and said guide means comprises a guide roller having an axis of rotation which is parallel to said axis of rotation of said folding roller.

4. Process as in claim 3 wherein said axis of rotation of said guide roller is maintained at a fixed distance from said axis of rotation of said folding roller.

5. Process as in claim 1 wherein said guide surface faces outward with respect to said axis of rotation of said assembly.

* * * * *